United States Patent [19]

Kostylev et al.

[11] Patent Number: 4,722,403

[45] Date of Patent: Feb. 2, 1988

[54] ANNULAR AIR-HAMMER APPARATUS FOR DRILLING HOLES

[75] Inventors: Alexandr D. Kostylev; Boris B. Danilov; Boris N. Smolyanitsky; Vladimir P. Boginsky; Jury N. Syryamin, all of Novosibirsk; David I. Kogan, Moscow; Oleg V. Smirnov, Moscow; Yacheslav N. Saveliev, Moscow, all of U.S.S.R.

[73] Assignee: Institut Gornogo Dela Sibirskogo Otdelenia Akademii Nauk Sssr, Novosibirsk, U.S.S.R.

[21] Appl. No.: 893,285

[22] Filed: Aug. 5, 1986

[30] Foreign Application Priority Data

Aug. 6, 1985 [SU] U.S.S.R. ..... 3942733

[51] Int. Cl.[4] ..... E21B 21/00; E21B 1/00

[52] U.S. Cl. ..... 175/296; 173/73; 173/78

[58] Field of Search ..... 175/296; 173/66–70, 173/73, 77–80, 134–138

[56] References Cited

U.S. PATENT DOCUMENTS

| | | | |
|---|---|---|---|
| 3,051,134 | 8/1962 | Lincoln | 173/78 |
| 3,164,214 | 1/1965 | Oelke | 173/138 |
| 3,524,511 | 8/1970 | Klemm | 175/296 |
| 3,854,539 | 12/1974 | Sweeney | 175/296 |
| 3,958,645 | 5/1976 | Curington | 173/78 |
| 3,986,565 | 10/1976 | Atkinson | 173/78 |
| 4,079,793 | 3/1978 | Mosely et al. | 173/80 |

FOREIGN PATENT DOCUMENTS

| | | |
|---|---|---|
| 2854461 | 6/1980 | Fed. Rep. of Germany . |
| 1133388 | 1/1985 | U.S.S.R. . |

*Primary Examiner*—Stephen J. Novosad
*Assistant Examiner*—Bruce M. Kisliuk
*Attorney, Agent, or Firm*—Fleit, Jacobson, Cohn & Price

[57] ABSTRACT

The annular air-hammer apparatus for drilling holes comprises a shell having fitted co-axially therein a chips-receiving sleeve, a hollow cylindrical case, and a ring-shaped hammer capable of reciprocating back and forth. The lower part of the shell accommodates a rock-cutting tool capable of moving axially with at least one blow-off passage formed by at least a single longitudinal groove made on the outer cylindrical surface of the rock-cutting tool. With the rock-cutting tool in its uppermost position, the blow-off passage communicates with an outlet space provided between the shell and the case.

4 Claims, 12 Drawing Figures

ANNULAR AIR-HAMMER APPARATUS FOR DRILLING HOLES

FIELD OF THE INVENTION

The invention relates to air-hammer apparatus employed in mining, construction, and geological prospecting using a concentric drill string and transport of cores and chippings through the central pipes of the device and the internal drill string by means of the return flow of the agent providing motive power, and more particularly it relates to annular air-hammer apparatus for drilling holes.

The invention can find most effective application in drilling holes for mineral exploration in permafrost regions and on the continental shelf, blasting rock in open pits, as well as in sinking pile foundations at construction sites. The use of the annular air-hammer apparatus facilitates dust suppression and makes geological information obtained from drilling prospecting boreholes more reliable. The reverse circulation of the agent providing motive power employed in annular air-hammer apparatus with a concentric drill string makes it possible to exclude the agent-hole wall contact for preventing its thawing and caving.

BACKGROUND OF THE INVENTION

There is known an annular air-hammer drilling apparatus (cf. FRG Pat. No. 2,854,461 IPC E21C 3/24, 1978) termed perforator, which incorporates a rock-cutting tool and an annular hammer contained in a cylindrical case with air-distributing ports. The perforator is provided with a check valve and an internal chips off-take pipe and is employed with a concentric drill string. Featuring complex design and light-gauge shapes, the perforator, however, lacks operational reliability and, therefore, fails to find wide industrial application.

There is also known an annular air-hammer drilling apparatus (cf. USSR Inventor's Certificate No. 1,133,388, IPC E21C 3/24, 1985), comprising a shell accommodating a chips-receiving sleeve, a hollow cylindrical case with inlet and outlet ports, all these fitted co-axially, the case carrying a ring-shaped hammer capable of reciprocating back and forth and forming forward- and back-stroke chambers with the case. The lower part of the shell accommodates a rock-cutting tool capable of moving axially with an axial opening and at least a single blow-off passage permanently connected with the air distribution system and with a bottom hole. Interposed between the hammer and the case is a sleeve with provision for axial displacement, which has an annular recess at its midlength fitted whereinto is a projecting stop of the hammer.

The above design features permit control of the time interval during which the compressed gaseous fluid is being fed into the working chambers and, consequently, increase the impact power of the apparatus. However, in the aforesaid device, spent air outflows from the working chambers directly into the chips-receiving sleeve by-passing the bottom hole. For this reason, due to the insufficient bottom-hole cleaning from cuttings, the axial opening of the rock-cutting tool and the chips-receiving sleeve are likely to be plugged up.

All in all, these factors affect drilling efficiency in permafrost.

SUMMARY OF THE INVENTION

It is an object of the present invention to provide for higher drilling efficiency in permafrost.

Another object of the invention is to provide for better hole cleaning from cuttings.

Still another object of the invention is to eliminate plugging.

These and other objects are accomplished due to the fact that in an annular air-hammer apparatus for drilling holes, comprising a shell accommodating a chips-receiving sleeve, a hollow cylindrical case with inlet and outlet ports, all these fitted co-axially, and a ring-shaped hammer capable of reciprocating back and forth, which forms forward- and back-stroke chambers with the case which are communicated with an air distribution system via the inlet and outlet ports, the lower part of the shell carrying a rock-cutting tool having an axial opening and capable of moving axially and at least a single blow-off passage permanently connected with the air distribution system and with a bottom hole, according to the invention, each blow-off passage of the rock-cutting tool is formed by at least a single longitudinal groove made on its outer cylindrical surface and with the rock-cutting tool in its uppermost position, is connected with the outlet space provided between the shell and the case at the same level with the outlet ports.

It will be noted that in the disclosed apparatus, the outlet line can be separated into two branches ensuring two essentially different operating modes. The fact that the blow-off passage of the rock-cutting tool is permanently connected in its uppermost position with the outlet space provides for rated operating performances (frequency and impact energy of a single stroke) and maximum impact power of the apparatus.

With the rock-cutting tool in its lowermost position, the slowdown operating mode is realized featuring lower frequency and impact energy of strokes, which is necessary for disposing of plugs that are likely to occur when drilling in permafrost rocks or in some formations containing ductile compact inclusions, say, clay. Thereby, the operating efficiency of the apparatus is increased.

It is expedient that each blow-off passage in the rock-cutting tool formed by longitudinal grooves on the rock-cutting tool be connected with the outlet space through openings provided in the lower part of the case.

Such an embodiment of the apparatus makes it possible to block, if necessary, the aforesaid blow-off passage with an upper portion of the outer surface of the rock-cutting tool, thereby ensuring the slowdown operating mode of the apparatus.

With the rock-cutting tool receiving impacts of decreased frequency and energy, the chips-receiving sleeve of the apparatus undergoes longitudinal reversal vibrations which result in a plug being effectively disposed of. This being the case, the most weak structural elements, say, thread provide for a specified life of the apparatus on account of decreased impact energy.

It is advisable that at least a single longitudinal groove be provided on the outer cylindrical surface of the rock-cutting tool on that side thereof which faces its upper end face, the groove being isolated from the blow-off passage of the rock-cutting tool and connecting the back-stroke chamber with the outlet space with the rock-cutting tool in its lowermost position.

Such an embodiment of the apparatus, due to a strictly definite ratio of the cross-sectional area of the aforesaid longitudinal groove to the back-stroke chamber volume, provides for a constant amount of air flow throttled from the chamber to the outlet space irrespective of the axial displacement of the rock-cutting tool under the action of impact loads. This stabilizes operating performances of the hammer unit in the slowdown operating mode, thereby ensuring higher effectiveness of the apparatus.

It is expedient that at least a single longitudinal groove be provided in the lower part of the shell on its cylindrical bore, the groove forming, together with the outer cylindrical surface of the rock-cutting tool, another blow-off passage permanently connected with the outlet space and with the bottom hole.

Such an embodiment of the apparatus makes it possible to select optimum sections of the outlet ducts to ensure that compressed air is fully expelled from the working chambers of the hammer unit under rated operating conditions and to provide for the slowdown operating mode with the blow-off passages of the rock-cutting tool blocked. This helps to make full use of the technological and operational advantages of the apparatus, which enable plugs in the rock-cutting tool and the chips-receiving sleeve to be disposed of without pulling the apparatus out of the hole, thereby significantly increasing drilling efficiency.

BRIEF DESCRIPTION OF THE DRAWINGS

In what follows the present invention will be now disclosed in a detailed description of an illustrative embodiment thereof with reference to the accompanying drawings, wherein.

FIG. I is a schematic longitudinal section view of an annular air-hammer apparatus for drilling holes, according to the invention, at a moment the hammer strikes against the rock-cutting tool.

DETAILED DESCRIPTION OF THE INVENTION

Figure 1:
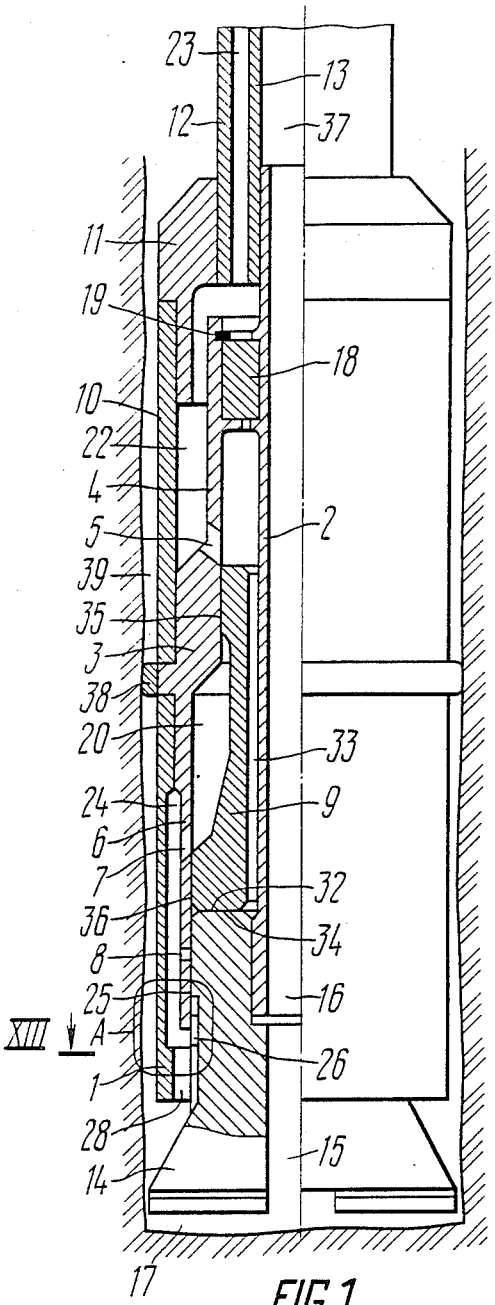
Figure 3:
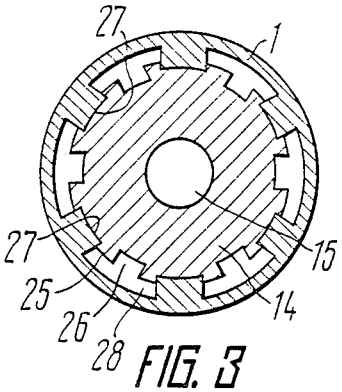
FIG. 3 is a section on line III—III in FIG. I.

An annular air-hammer apparatus for drilling holes (FIGS. 1, 2, 3, 4) comprises a shell I, a chips-receiving sleeve 2, a hollow cylindrical case 3 with inlet ports 5 provided in the upper part 4 thereof and with outlet ports 7 and a throttle duct 8 provided in the lower part 6 thereof. The case 3 accommodates a stepped ring-shaped hammer 9. In its upper part, the case 3 is connected via a junction pipe 10 with an adapter II, to which a concentric drill string is attached, consisting of an external pipe 12 and an internal pipe 13, the latter being connected with the chips-receiving sleeve 2.

The lower part 6 of the case 3 accommodates a rock-cuttting tool 14 provided with an axial opening 15 and capable of moving axially, the opening serving to communicate a bore 16 of the chips-receiving sleeve 2 with a bottom hole 17.

Fitted in the axial opening 15 of the rock-cutting tool 14, the chips-receiving sleeve 2 is attached to the upper part 4 of the case 3 by virtue of a sleeve 18 and a lock ring 19.

The ring-shaped hammer 9 forms a forward-stroke chamber 20 with the case 3 and a back-stroke chamber 21, with the case 3, the chips-receiving sleeve 2, and the rock-cutting tool 14.

Provided between the junction pipe 10 and the upper part 4 of the case 3 is a pressure chamber 22 permanently connected with a line 23 fed wherethrough is a compressed gaseous fluid.

The chambers 20 and 21 alternately communicate with the compressed air line 23 via the inlet ports 5 through the pressure chamber 22, and with an outlet space 24 provided between the shell I and the lower part 6 of the case 3, via the outlet ports 7.

Provided on an outer cylindrical surface 25 of the rock-cutting tool 14 are blow-off passages 26 formed by, say, longitudinal grooves which are aerodynamically connected with the outlet space 24 of the apparatus with the rock-cutting tool 14 (FIGS. I, 2) in its upper most position.

The lower part of the shell I has additional blow-off passages 28 (FIGS. I,2) provided on its cylindrical bore 27 (FIG. 3), which serve to feed air from the outlet space 24 to the bottom hole 17.

Figure 6:
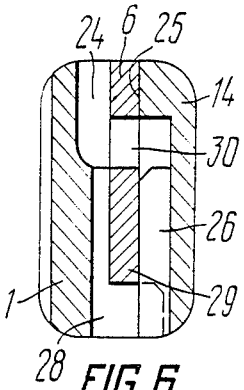
FIG. 6 is a scaled-up representation of unit B in FIG. 5.
Figure 2:
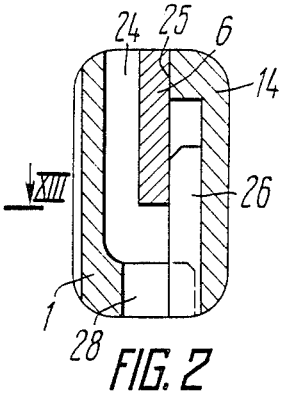
FIG. 2 is a scaled-up representation of unit A in FIG. I.
Figure 4:
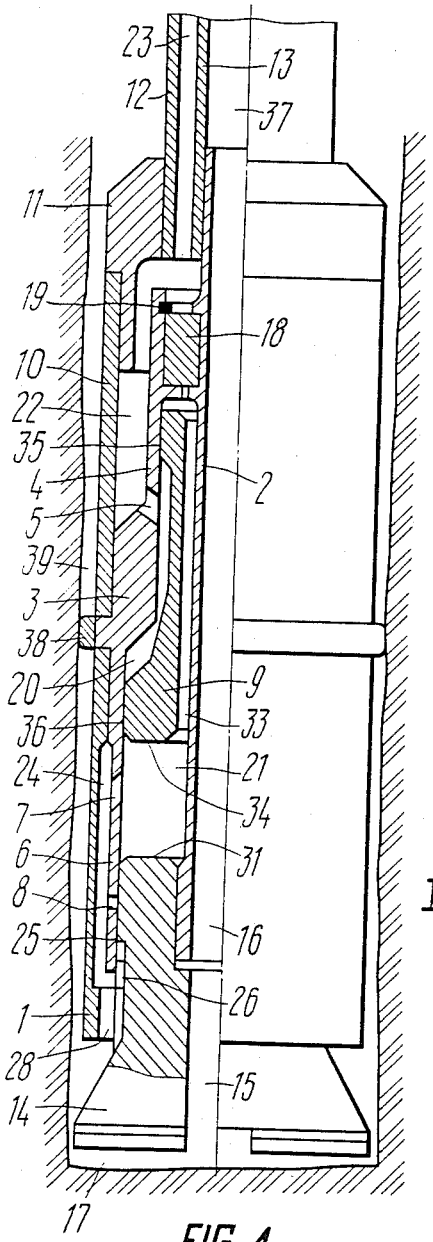
FIG. 4 is a longitudinal section view of an annular air-hammer apparatus for drilling holes, according to the invention, at a moment the hammer is on the back stroke (in its uppermost position)
Figure 5:
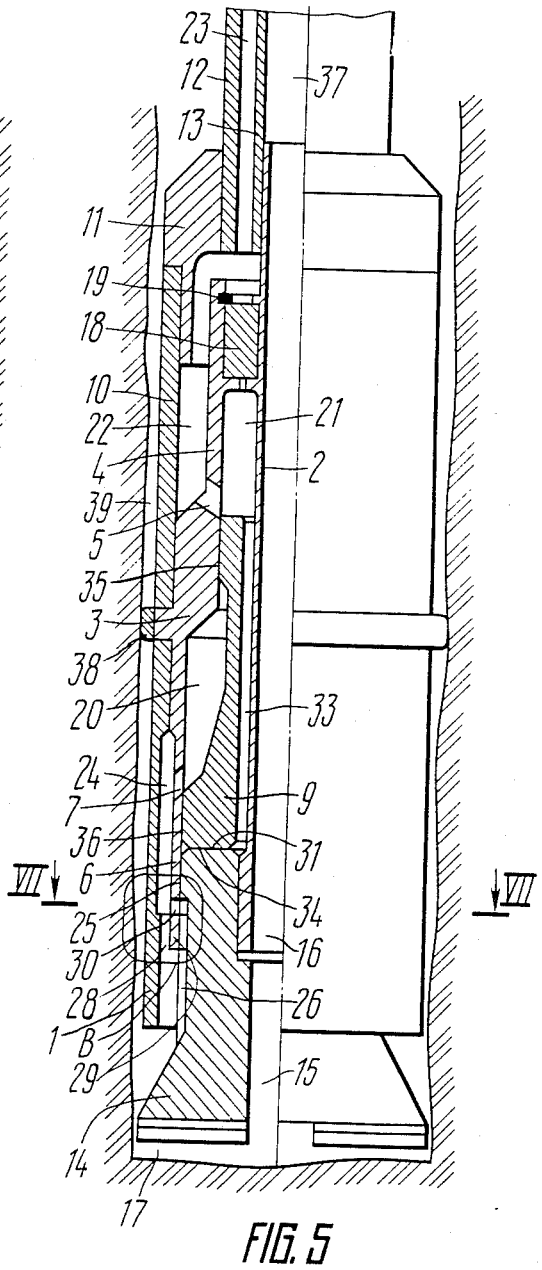
FIG. 5 is a view of the device of FIG. 4, wherein an opening is provided in the lower part of the case.
Figure 7:
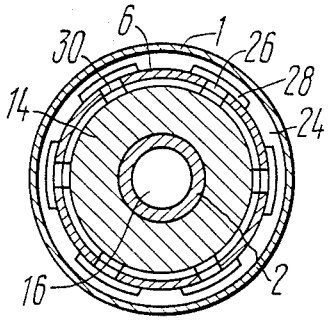
FIG. 7 is a section on line VII—VII in FIG. 5.

In an embodiment of the annular air-hamer apparatus shown in FIGS. 5, 6, 7, a base plate 29 of the case 3 is fitted in the bore of the lower part of the shell I. Featuring bracketless fastening of the case, the apparatus is a fairly robust structure with a high operational reliability.

In the aforesaid embodiment, provision is made for an opening 30 in the lower part 6 of the case 3 to connect the outlet space 24 with the blow-off passages 26 of the rock-cutting tool 14. As a result, the total cross-sectional area of the outlet ducts increases, thereby improving operating performances of the apparatus.

Figure 8:
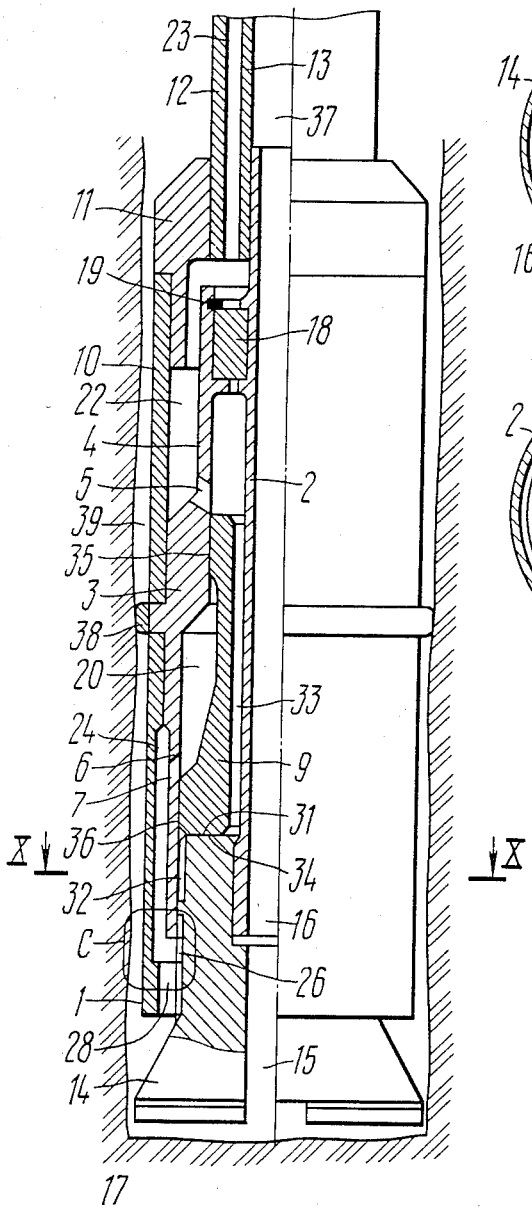
FIG. 8 is a view of the device of FIG. 4, wherein a longitudinal groove provided on that side of the rock-cutting tool which faces its upper end face is isolated from the blow-off passage of the rock-cutting tool.
Figure 10:
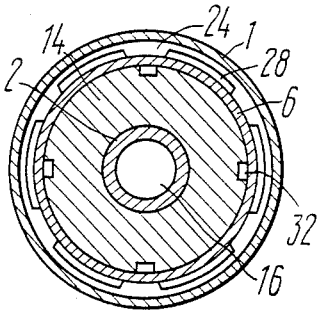
FIG. 10 is a section on line X—X in FIG. 8.
Figure 9:
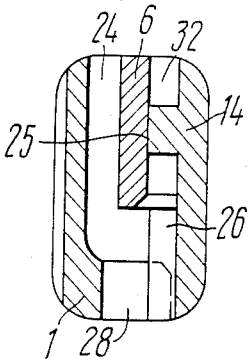
FIG. 9 is a scaled-up representation of unit C in FIG. 8.

In an embodiment of the annular air-hammer apparatus for drilling holes shown in FIGS. 8,9,10, there are provided longitudinal grooves 32 on the outer cylindrical surface 25 of the rock-cutting tool 14 on that side thereof which faces its upper end face 31, the grooves being isolated from the blow-off passage 26 in the rock-cutting tool 14. The aforesaid longitudinal grooves 32 serve to ensure the slowdown operating mode of the apparatus with the rock-cutting tool 14 in its lowermost position. This embodiment is equally effective as the one shown in FIGS. I,5.

The annular air-hammer apparatus for drilling holes operates as follows.

Compressed gaseous fluid, say, compressed air is fed into the apparatus through the annular space 23 (FIG. I) of the concentric drill string, enters the pressure chamber 22, wherefrom it passes through the inlet ports 5 of the upper part 4 of the case 3 into the back-stroke chamber 21 of the hammer 9. Passing through an annular passage 33, compressured air flows under a lower end face 34 of the hammer 9. At this moment the forward-stroke chamber 20 of the hammer 9 communicates with the bottom hole 17 via the outlet ports 7 and the outlet space 24. With compressed air acting on the lower end face 34, the hammer 9 moves upwards (back stroke). The inlet and outlet ports 5,7 of the case 3 being closed within a short period of time by collars 35 and 36 respectively of the hammer 9, the latter moves upwards due to the energy of air expansion in the lower part of the back-stroke chamber 21. With the hammer 9 moving further upwards, the outlet ports 7 connect the back-stroke chamber 21 with the outlet space 24 and with the low-pressure bottom hole 17, whereas the inlet ports 5 connect the forward-stroke chamber 20 with the pressure chamber 22 and with the high-pressure compressed air line 23. Compressed air is expelled from the back-stroke chamber 21 into the outlet space 24, pressure in the chamber 21 dropping to become lower than that in the line. As compressed air is expelled from the back-stroke chamber 21, the forward-stroke chamber 20 becomes filled in with compressed air from the line.

Under the effect of compressed air line pressure, the hammer 9 (FIG. 4) comes to a stop in its uppermost position, thereafter moving downwards to strike against the rock-cutting tool 14. Prior to the impact the outlet ports 7 open into the outlet space 24, thereby connecting the forward-stroke chamber 20 with the bottom hole 17. The inlet ports 5 likewise open to communicate the compressed air line 23 with the back-stroke chamber 21 of the hammer via the pressure chamber 22. Thus, with the air flows changing over, the operating cycle of the hammer unit is repeated.

After air is expelled from the working chambers 20 and 21 alternately, it enters the outlet space 24 wherefrom it outflows through two lines.

Partly it goes to the bottom hole 17 through the blow-off passages 26 of the rock-cutting tool 14 and partly, through the additional blow-off passages 28 in the lower part of the shell I. When at the bottom hole 17, the two air flows merge carrying cuttings into the bore 16 of the chips-receiving sleeve 2 via the axial opening 15 of the rock-cutting tool 14 and subsequently bring them to the surface through a chips-carrying duct 37 of the internal pipe 13 of the concentric drill string.

A packer 38 mounted on the outer surface of the case 3 prevents air and chips from entering a shell-borehole annulus 39.

A feature of the annular air-hammer apparatus for drilling holes is that its hammer unit can operate both with rated performances (frequency and impact energy of a single stroke and maximum impact power) and in the slowdown mode, a decrease in the above parameters being controlled.

Figure 11:
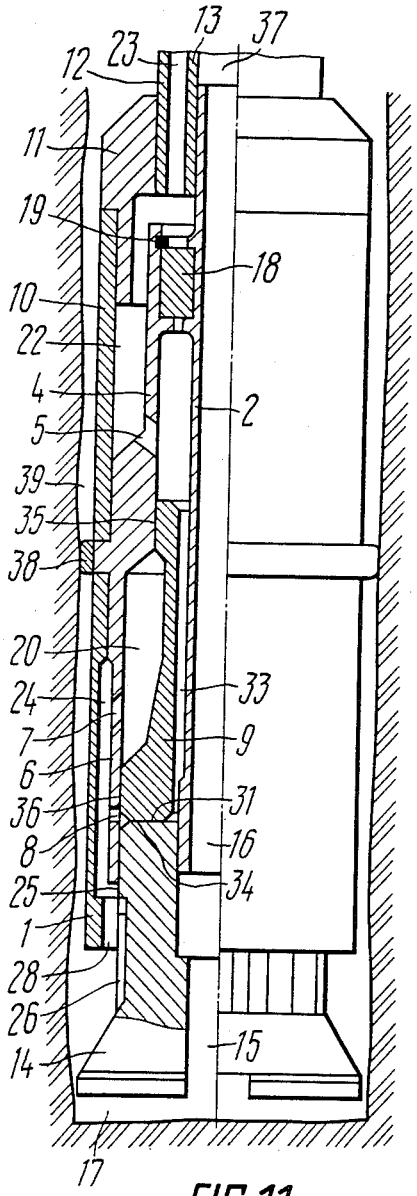
FIG. 11 is a longitudinal section view of the device of FIG. 4, operating in a slowdown mode at a moment the hammer strikes against the rock-cutting tool.
Figure 12:
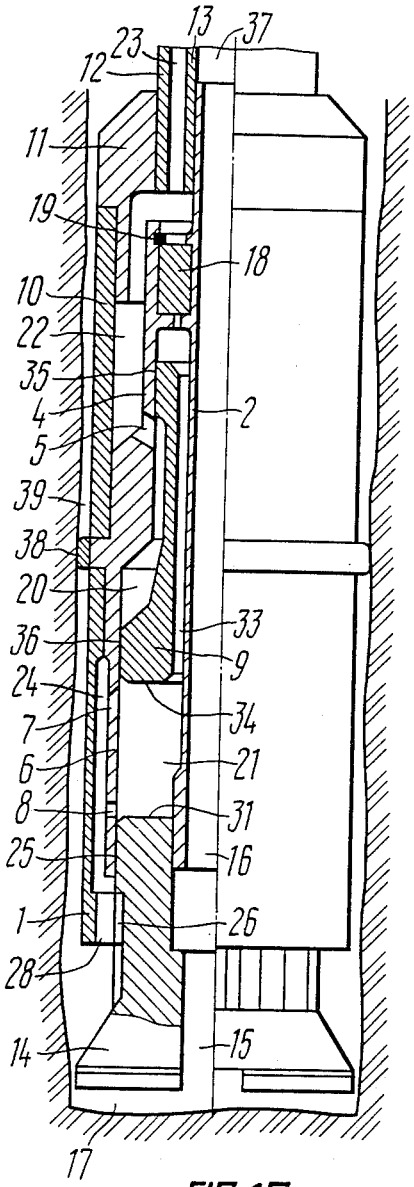
FIG. 12 is a longitudinal section view of the device of FIG. 4, operating in a slowdown mode at a moment the hammer is on the back stroke (in its uppermost position).

The slowdown operating mode is aimed at disposing of plugs effectively, which are likely to occur in the axial opening 15 (FIGS. 11, 12) of the rock-cutting tool 14 and in the bore 16 of the chips-receiving sleeve 2 when drilling permafrost rocks containing argillaceous inclusions.

For operating in the slowdown mode, the annular air-hammer apparatus is lifted above the hole bottom. The rock-cutting tool 14 moves down along its axis below the level of the throttle duct 8, partly closing one of the outlet lines with its outer cylindrical surface 25, thereby reducing their total cross-sectional area.

The operating cycle of the hammer unit is the same as the one featuring rated performances: with the inlet ports 5 (FIG. 11) open, into the back-stroke chamber 21, the hammer 9 moves upwards; with the inlet ports 5 (FIG. 12) open into the forward-stroke chamber 20, the hammer 9 moves downwards to strike against the rock-cutting tool 14. Thereafter, the cycle is repeated.

However, the partial closing of the outlet line results in compressed air being not wholly expelled from the working chambers 20 and 21 of the hammer unit, thereby reducing the frequency and impact energy of strokes and impact power of the apparatus.

With the rock-cutting tool 14 in its lowermost position, (FIG. 11), the back-stroke chamber 21 is partly depressurized, i.e. it is permanently connected via the throttle duct 8 with the outlet space 24 and the outlet air line formed by additional blow-off passages 28 of the shell 1. This fact results in a higher flow rate of the agent providing motive power through the back-stroke chamber 21 and, consequently, in a lower mean pressure of compressed air therein during the back stroke, which further decreases operating performances of the apparatus.

When in the slowdown operating mode, the apparatus features high air volume discharge, thereby providing for better borehole cleaning from cuttings. The low-power impact causes vibration of the apparatus and, in particular, of its chips-receiving sleeve, which ensures, in combination with intensive blowing, that plugs are effectively disposed of.

A provision is made in the present invention to control variation of the operating performances of the apparatus, which improves its operational capabilities and effectiveness in the process of drilling.

What is claimed is:

1. An annular air-hammer apparatus for drilling holes, comprising;

a shell with a cylindrical bore, an upper part, and a lower part;

a chips-receiving sleeve fitted co-axially in said shell and having a bore for carrying chips out of the bottom hole;

a hollow cylindrical case rigidly fitted in said shell and featuring a lower part and inlet and outlet ports;

a ring-shaped hammer moving axially in said case and forming, together with said case, a forward-stroke chamber and a back-stroke chamber communicating with said inlet and outlet ports of said case for the feed and dissolving of compressed gaseous fluid to and from said chambers;

a rock-cutting tool featuring an outer cylindrical surface and an upper end face and fitted in said lower part of said shell, which cutting tool moves axially between an uppermost and a lowermost position and has an axial opening;

said chips-receiving sleeve communicating with ambient air by virtue of said axial opening;

an outlet space provided between said shell and said case at the same level with said outlet ports;

at least a single first blow-off passage formed by at least a single longitudinal groove made on said outer cylindrical surface of said rock-cutting tool and communicating with said outlet space, with said rock-cutting tool moving under the action of said hammer in its uppermost position and at least a single second blow-off passage formed by at least a single longitudinal groove in the cylindrical bore in the lower part of the shell and a longitudinal groove in the outer cylindrical surface of the rock cutting tool.

2. A device as claimed in claim 1, wherein said first blow-off passage is formed by said single longitudinal groove of said rock-cutting tool for connection with said outlet space when said rock-cutting tool is in its uppermost position; openings being provided in said lower part of said case for connecting said first blow-off passage with said outlet space.

3. An annular air-hammer apparatus for drilling holes, comprising;

a shell with a cylindrical bore, an upper part, and a lower part;

a chips-receiving sleeve fitted co-axially in said shell and having a bore for carrying chips out of the bottom hole;

a hollow cylindrical case rigidly fitted in said shell and featuring a lower part and inlet and outlet ports;

a ring-shaped hammer moving axially in said case and forming, together with said case, a forward-stroke chamber and a back-stroke chamber communicating with said inlet and outlet ports of said case for the feed and dissolving of compressed gaseous fluid to and from said chambers;

a rock-cutting tool featuring an outer cylindrical surface and an upper end face and fitted in said lower part of said shell, which cutting tool moves axially between an uppermost and a lowermost position and has an axial opening;

said chips-receiving sleeve communicating with ambient air by virtue of said axial opening;

an outlet space provided between said shell and said case at the same level with said outlet ports;

at least a single first blow-off passage formed by at least a single longitudinal groove made on said outer cylindrical surface of said rock-cutting tool and communicating with said outlet space, with said rock-cutting tool moving under the action of said hammer in its uppermost position, wherein at least a single second blow-off passage is formed by at least a single longitudinal groove made on said outer cylindrical surface of said rock-cutting tool extending from an upper end face of the rock-cutting tool;

said second blow-off passage being isolated from said first blow-off passage and connecting said back-stroke chamber with said outlet space, when said rock-cutting tool is in its lowermost position, for throttling air flow from said back-stroke chamber.

4. A device as claimed in claim 1, wherein at least a single third blow-off passage is formed by at least a single longitudinal groove made on said cylindrical bore in said lower part of said shell and said outer cylindrical surface of said rock-cutting tool;

said each third blow-off passage permanently connected with said outlet space.

* * * * *